US006098604A

United States Patent [19]

Nemoto et al.

[11] Patent Number: 6,098,604

[45] Date of Patent: Aug. 8, 2000

[54] CYLINDER IDENTIFYING DEVICE FOR INTERNAL COMBUSTION ENGINES

[75] Inventors: Mamoru Nemoto, Hitachiohta; Masami Nagano, Hitachinaka; Hiroto Ishikawa, Naka-machi, all of Japan

[73] Assignees: Hitachi, Ltd., Tokyo; Hitachi Car Engineering Co., Ltd., Hitachinaka, both of Japan

[21] Appl. No.: 09/240,870

[22] Filed: Feb. 1, 1999

[30] Foreign Application Priority Data

Jan. 30, 1998 [JP] Japan ..... 10-018528

[51] Int. Cl.[7] ..... F02P 7/067; F02P 11/00

[52] U.S. Cl. ..... 123/612; 701/110; 701/114

[58] Field of Search ..... 123/406.61, 406.62, 123/406.63, 612, 613, 617; 701/110, 114

[56] References Cited

U.S. PATENT DOCUMENTS

| | | | |
|---|---|---|---|
| 4,250,846 | 2/1981 | Menard | 123/406.61 |
| 4,870,587 | 9/1989 | Kumagai | 701/110 |
| 4,924,830 | 5/1990 | Abe | 123/612 |
| 4,926,822 | 5/1990 | Abe et al. | 123/406.62 |
| 4,953,531 | 9/1990 | Abe | 123/406.63 |
| 5,426,587 | 6/1995 | Imai et al. | 701/110 |

*Primary Examiner*—Willis R. Wolfe

*Attorney, Agent, or Firm*—Evenson, McKeown, Edwards & Lenahan, P.L.L.C.

[57] ABSTRACT

The present invention relates to a cylinder identifying device to identify the cylinder or cylinders of a running internal combustion engine in a specific stroke, and more particularly to a cylinder identifying device for internal combustion engines suitable for automotive use. A signal plate for detecting revolutions, fitted to the camshaft, is provided with two signal generating means per cylinder; a cylinder identifying signal is added before said two signals; and two sensors are so arranged as to have a phase difference from the detection of said projection. Bit patterns are prepared from the outputs of these two sensors correspondingly to individual cylinders, and cylinder identification is accomplished according to the combination of these patterns. The phase difference here is so set that the number of signals detected by the second sensor (sub-crank angle sensor, hereinafter abbreviated SCAS), out of said two sensors, between signals detected by the first sensor (base crank angle sensor, hereinafter abbreviated to BCAS), can be one of three kinds. A signal from a BCAS signal input means is received, and the number of signals generated is measured by a signal counting means. Further a SCAS signal is received by a SCAS signal input means, and bit patterns are generated by a bit preparing means. Cylinder identification is performed according to a bit pattern for cylinder identification from a cylinder identification criterion storage means, another bit pattern generated by said bit preparing means and the number of signals generated by the signal counting means.

6 Claims, 11 Drawing Sheets

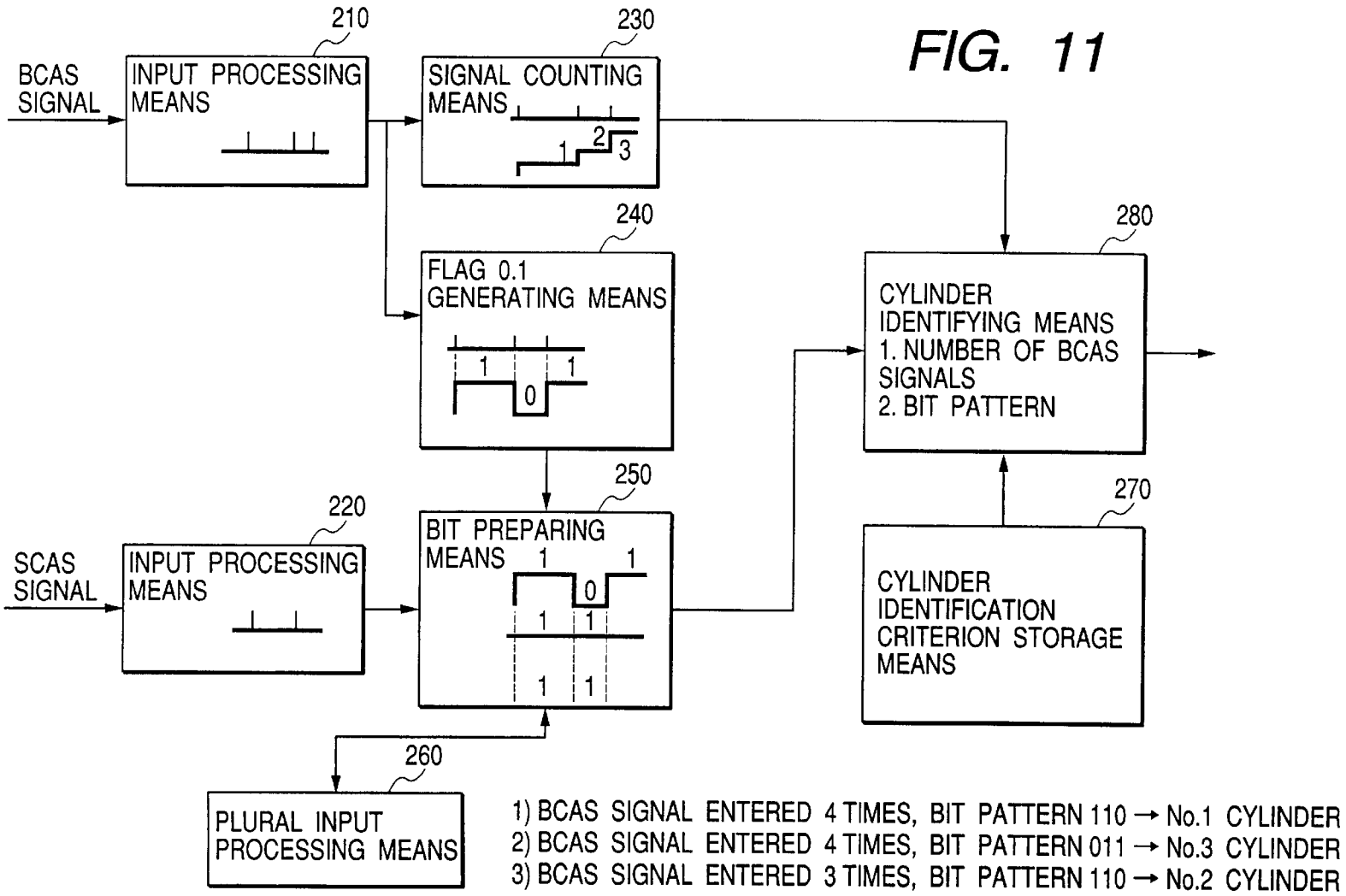
FIG. 11
BCAS SIGNAL
210
INPUT PROCESSING MEANS
230
SIGNAL COUNTING MEANS
240
FLAG 0.1 GENERATING MEANS
SCAS SIGNAL
220
INPUT PROCESSING MEANS
250
BIT PREPARING MEANS
260
PLURAL INPUT PROCESSING MEANS
280
CYLINDER IDENTIFYING MEANS
1. NUMBER OF BCAS SIGNALS
2. BIT PATTERN
270
CYLINDER IDENTIFICATION CRITERION STORAGE MEANS
1) BCAS SIGNAL ENTERED 4 TIMES, BIT PATTERN 110 → No.1 CYLINDER
2) BCAS SIGNAL ENTERED 4 TIMES, BIT PATTERN 011 → No.3 CYLINDER
3) BCAS SIGNAL ENTERED 3 TIMES, BIT PATTERN 110 → No.2 CYLINDER

CYLINDER IDENTIFYING DEVICE FOR INTERNAL COMBUSTION ENGINES

BACKGROUND OF THE INVENTION

The present invention relates to a cylinder identifying device to identify the cylinder or cylinders of a running internal combustion engine in a specific stroke, and more particularly to a cylinder identifying device for internal combustion engines suitable for automotive use.

A cycle of the operation of an internal combustion engine consists of a plurality of strokes, two or four, and accordingly it is necessary for controlling the timing of ignition, fuel injection or the like of a multi-cylinder combustion engine having two or more cylinders to identify the cylinder or cylinders in a specific stroke, e.g. a compression stroke. This requires a cylinder identifying device.

According to the prior art, there are a number of such cylinder identifying devices. A first embodiment of the prior art for this purpose, as illustrated in FIGS. 2 and 3 of the Japanese Patent Laid-open No. Sho 63-37336, the compression stroke of a first cylinder is identified with signals from a crank angle detecting sensor and a cylinder identifying sensor fitted to the camshaft.

According to a second embodiment of the prior art, as disclosed in the Japanese Patent Laid-open No. Hei 5-86953, three projections for crank angle identification are provided at unequal intervals on a revolution detecting disk mounted on the camshaft; a projection for identifying a first cylinder is added so that a plurality of signals be generated at unequal intervals; the arrayed state of the pulse intervals of this plurality of signals is checked; the crank angle is identified at a point of time when a prescribed array pattern attributable solely to the crank angle identifying pulse is detected; and the cylinder is identified at a point of time when a prescribed array pattern including the cylinder identifying pulse is detected or when a variation in a prescribed pulse interval is detected at a cylinder identifying pulse. The method to identify the cylinder at a point of time when a variation in a prescribed pulse interval is detected is briefly described below with reference to FIG. 2. FIG. 2, referring to a three-cylinder internal combustion engine, illustrates the relationship between the stroke of each cylinder and the position of detection by the crank angle sensor. Marks ○ for strokes denote suction, and arrows indicate positions of ignition. For the compression stroke of each cylinder, two signals (A, B) are generated, and there further is a signal C for the detection of the compression stroke of one cylinder. Two revolutions of the crankshaft in the diagram constitute the basic cycle of a four-stroke internal combustion engine. Detailed positional relationships among the signals A, B and C in FIG. 2 are shown in FIG. 3. A signal CR signifies the generating position of a signal to be detected by the crank angle sensor. The signal A is generated 75° before the top dead point of compression of each cylinder. The signal B is also generated 5° before the top dead point of compression of each cylinder. The signal C is generated only once in two revolutions of the crankshaft in a position 210° before the top dead point of compression of one cylinder, and the angle between signals C is narrower than for other signals. Cylinder identification is finalized when the condition of identification given in the table is met. More specifically, the identification is made according to Formula 1 on the basis of the hysteresis of the time between signals CR.

$$\text{TRATIO} \geqq \text{MKRAT\#} \qquad \text{Formula 1}$$

where MKRAT# is a cylinder identification coefficient, and TRATIO is the pulse period ratio.

Calculated is done by Formula 2.

$$(\text{Told}\mathbf{1}+\text{Told}\mathbf{2})/\text{T} \qquad \text{Formula 2}$$

where Told1 is the pulse period immediately before, Told2, the pulse period immediately before Told1, and T, the latest pulse period.

Said MKRAT# takes a value of 5 or so. Thus, as converted into an angle ratio, at the time of the generation of a signal C, Told2 is 175°, Told 1, 65°, and T, 35°, so that TRATIO=(175+65)/35=7.5. Similarly, at the time of the generation of a signal B, Told2 is 65°, Told 1, 175°, and T, 65°, so that TRATIO=(65+175)/65=3.7. At the time of the generation of a signal A, Told2 is 170°, Told 1, 65°, and T, 170°, so that TRATIO=(175+65)/170=1.38. To sum up, as TRATIO is 1.38 at the time of signal A generation, 3.7 at the time of signal B generation, and 7.5 at the time of signal C generation, the signal C can be discriminated from the signals A and B if the cylinder identification coefficient MKRAT# is set to be 5.

However, first, the first embodiment of the prior art referred to above involves the problem that, when the internal combustion engine is started, no cylinder identification can be done until the camshaft completes a maximum of one full revolution, i.e. until the crankshaft completes two revolutions. Then, the second embodiment of the prior art, though stroke identification of the internal combustion engine is promptly done, there is a risk of misidentification if the internal combustion engine widely fluctuates in revolution because the identification is based on the time ratio among signals. Furthermore, since it has only one sensor for detection of revolutions (crank angle sensor), though it has a cost advantage, it entails the problem that the internal combustion engine will stop in the event of sensor failure.

SUMMARY OF THE INVENTION

A signal plate for detecting revolutions, fitted to the camshaft, is provided with two signal generating means per cylinder; a cylinder identifying signal is added before said two signals; and two sensors are so arranged as to have a phase difference from the detection of said projection. Bit patterns are prepared from the outputs of these two sensors correspondingly to individual cylinders, and cylinder identification is accomplished according to the combination of these patterns. The phase difference here is so set that the number of signals detected by the second sensor (sub-crank angle sensor, hereinafter abbreviated SCAS), out of said two sensors, between signals detected by the first sensor (base crank angle sensor, hereinafter abbreviated to BCAS), can be one of three kinds, including 0, 1 and 2. A signal from a BCAS signal input means is received, and the number of signals generated is measured by a signal counting means. Further a SCAS signal is received by a FLAG 0, 1 generating means for setting the FLAG state upon every input of the BCAS signal and by a SCAS signal input means, and a bit pattern is generated by a bit preparing means. Further, cylinder identification is performed according to a bit pattern for cylinder identification from a cylinder identification criterion storage means, another bit pattern generated by said bit preparing means and the number of signals generated by the signal counting means.

According to the invention, there is provided a cylinder identifying device for internal combustion engines so disposed that, where control is effected, using a plurality of kinds of reference signals per cylinder, with only one signal plate for cylinder identification and revolution detection fitted to the camshaft, discrimination of the reference signals can be accomplished without delay, unaffected by any fluctuation in the revolution of the internal combustion engine, and even in the event of failure of the first crank angle sensor (BCAS), the internal combustion engine can be prevented from stopping by using the second crank angle sensor (SCAS).

BRIEF DESCRIPTION OF THE DRAWINGS

FIG. 11 is a block diagram of the cylinder identifying method according to the invention.

DESCRIPTION OF THE PREFERRED EMBODIMENTS

Figure 4:
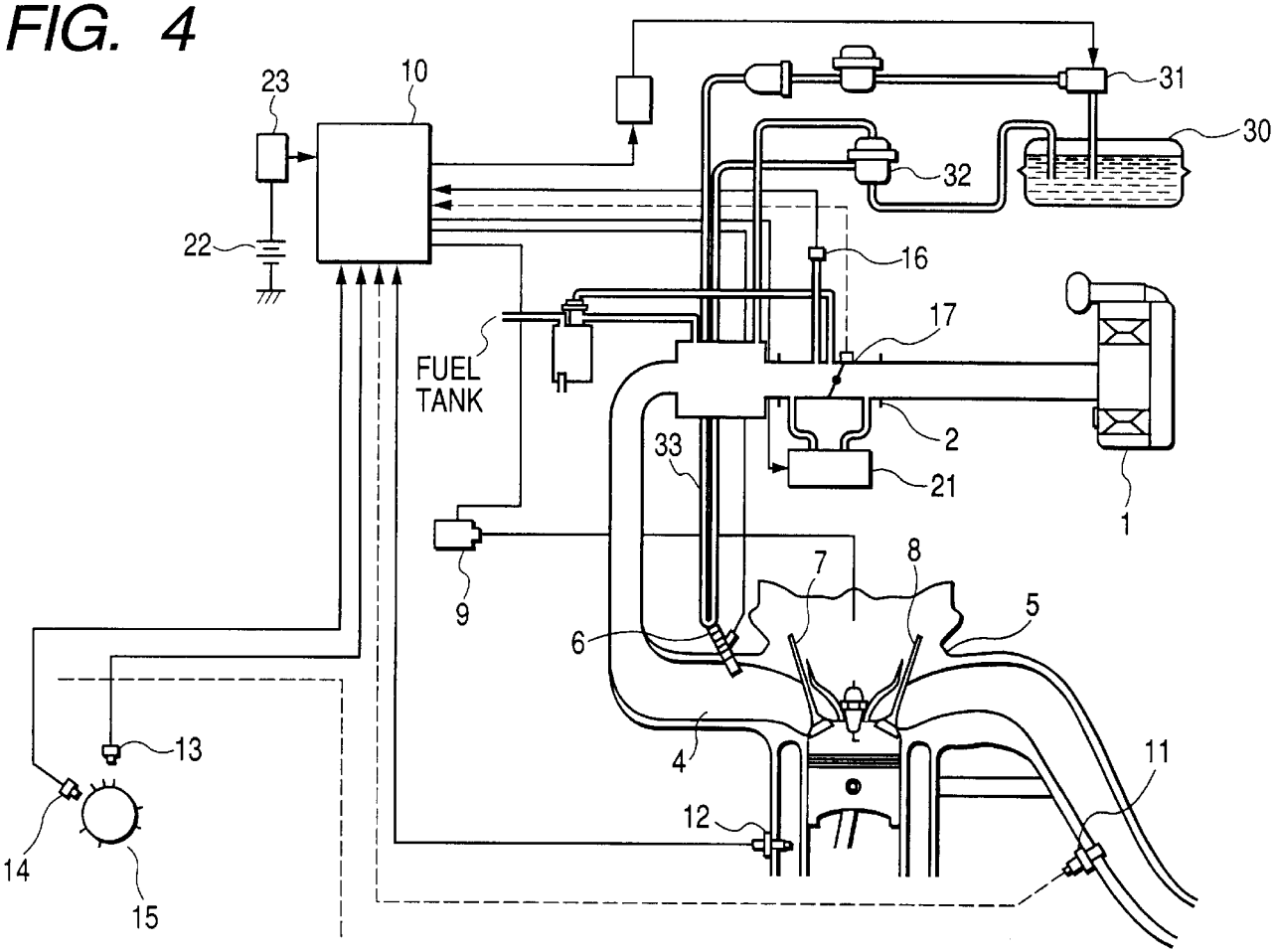
FIG. 4 is a diagram of the system configuration of an internal combustion engine to which the invention is applied.

A preferred embodiment of the present invention will be described below. First, FIG. 4 is a diagram of the system configuration of an internal combustion engine to which the invention is applied, wherein reference numeral 1 denotes an air cleaner; 2, a throttle assembly or body provided with a throttle for controlling the quantity of air intake, whose outlet is fitted with a suction manifold 4 for branching air supply to the cylinders of the internal combustion engine 5; and 6, an electronically controlled fuel injection valve fitted to the suction manifold 4. The internal combustion engine is provided with an air intake valve 7 on its suction side and an exhaust valve 8 on its discharge side. Reference numeral 10 denotes a controller, which receives as its inputs the outputs of an $O_2$ sensor 11, a water temperature sensor 12, a BCAS (base crank angle sensor) 13, an SCAS (sub-crank angle sensor) 14, a pressure sensor 16 and a throttle sensor 17 among others, and supplies control signals to the fuel injection valve 6, an ignition coil 9, an ISC valve 21 and a fuel pump 31 among others.

Figure 5:
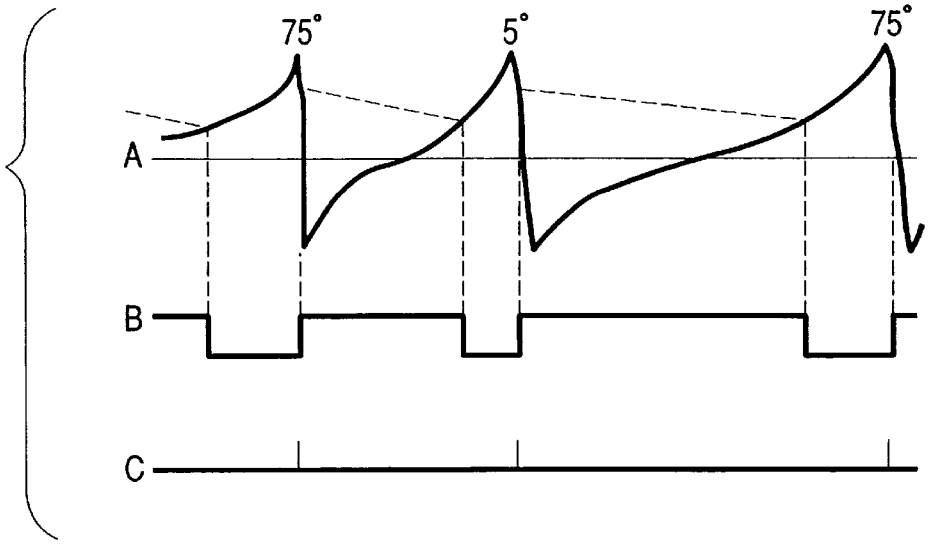
FIG. 5 is a diagram showing the output characteristics of the revolution sensor.
Figure 6:
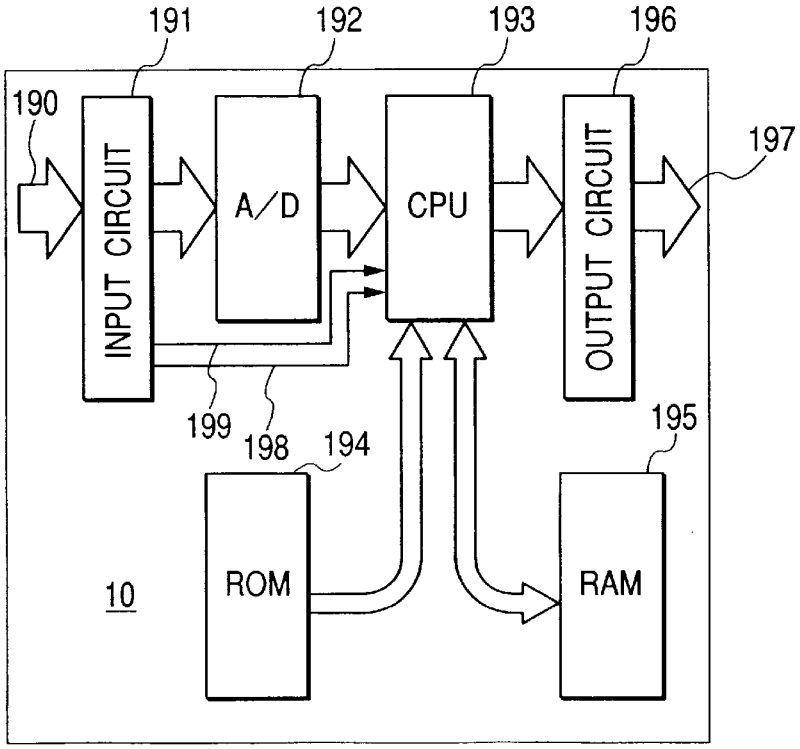
FIG. 6 is a diagram of the internal configuration of the controller 10 according to the invention.

Reference numeral 22 denotes a battery; 23, a main relay for the controller 10; 24, a fuel pump relay; and 30, a fuel chamber, from which fuel is sucked by the fuel pump 31 and, after its pressure is adjusted by a pressure regulator 32, reaches the fuel injection valve 6 via fuel piping 33. The exact volume of injection by the fuel injection valve 6 is calculated and determined by the controller 10 on the basis of inputs from various sensors. The BCAS 13 and the SCAS 14, as shown in FIG. 5, detect a change A in magnetic field, occurring every time a projection provided on a signal plate 15, generates a signal B with an internal processing circuit, and delivers it to the controller 10. FIG. 6 illustrates the internal configuration of the controller 10. The controller 10 consists of a computer comprising an input circuit 191, an A/D converting unit 192, a central processing unit 193, a ROM 194, a RAM 195 and an output circuit 196. The input circuit 191 is intended to accept analog signals (for instance, signals from the water temperature sensor 12 and the throttle opening sensor 9), clear the signals of noise components, and supply the cleared signals to the A/D converting unit 192. The central processing unit 193 has functions to execute various controls mentioned above and diagnoses by taking in the result of the A/D conversion and executing a fuel injection control program and prescribed programs for other controls stored in media including the ROM 194. The results of arithmetic operation and of said A/D conversion are temporarily stored in the RAM 195, and the results of arithmetic operation is also supplied via the output circuit 196 as a control output signal 197 to be used for the control of the fuel injection valve 6 and the ignition coil 9 among others. On the other hand, signals from the BCAS 13 and the SCAS 14, after similarly undergoing discrimination of the presence or absence of signals by the input circuit 191, are delivered as high/low signals to the central processing unit 193 via signal lines 198 and 199. The central processing unit 193 is so configured that interrupt processing be accomplished at a timing represented by C in FIG. 5 when the voltage level of the signal line 198 has changed from low to high.

Figure 7:
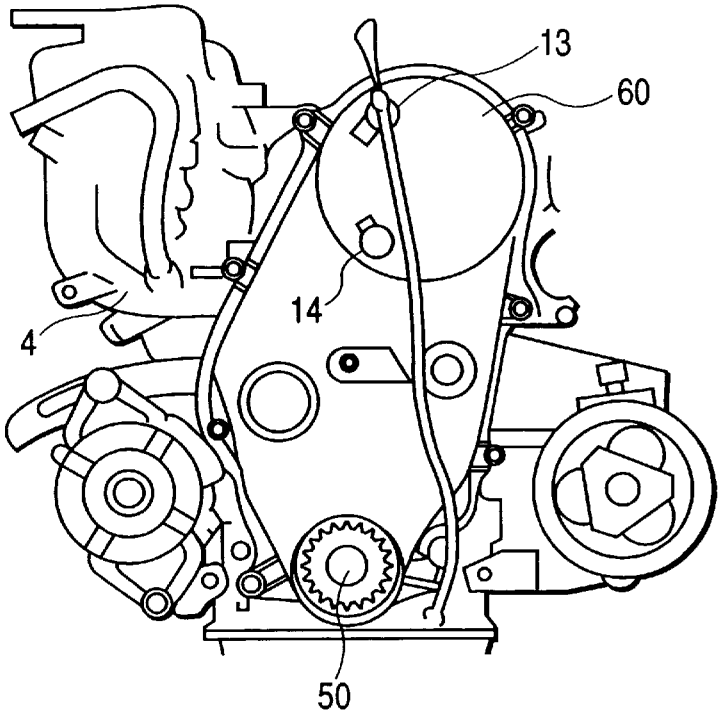
FIG. 7 is a diagram illustrating how the revolution sensor according to the invention is fitted to an internal combustion engine.
Figure 8:
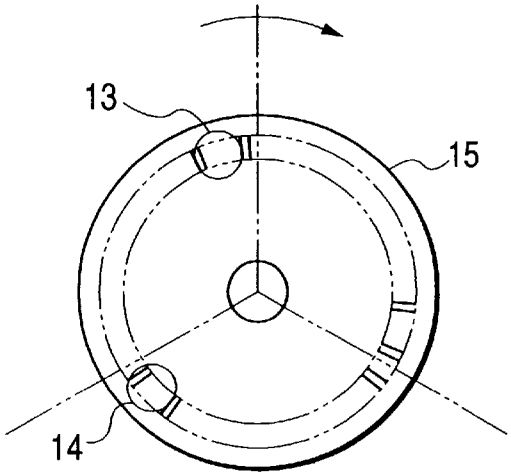
FIG. 8 is a diagram illustrating the positional relationship between the revolution sensor and the signal plate according to the invention.
Figure 9:
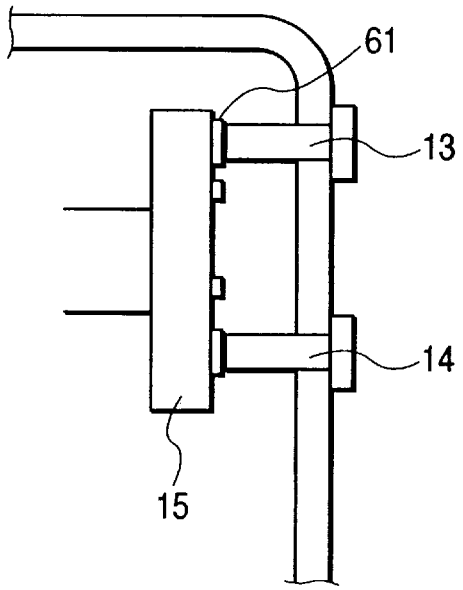
FIG. 9 is a diagram illustrating details of the positional relationship between the revolution sensor and the signal plate according to the invention.

On the other hand, the BCAS 13 and the SCAS 14 are fitted as illustrated in FIG. 7. Referring to FIG. 7 which shows a front view of the internal combustion engine, within a cam cover 60, the signal plate 15 fitted to the camshaft is installed as opposed to a crankshaft 50, and revolves at ½ of the frequency of the crankshaft 50. Their positional relationship is shown in FIG. 8. As illustrated, the BCAS 13 and the SCAS 14 are fitted to the projection of the signal plate 15. FIG. 9 shows a side view of the state of FIG. 8, illustrating a configuration in which changes in the magnetic field of the projection 61 provided on the signal plate 15 are detected.

Figure 10:
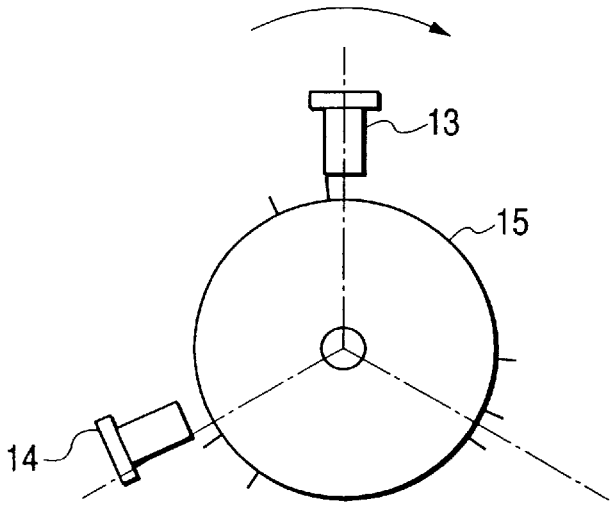
FIG. 10 is a diagram illustrating another example of positional relationship between the revolution sensor and the signal plate according to the invention.

FIG. 10 illustrates another detecting means in which the BCAS 13 and the SCAS 14 are arranged in the circumferential direction of the signal plate 15. They can be fitted as shown in FIG. 9 or in FIG. 10 or in the combination of both. Incidentally, said projection 61 (convex) may obviously be replaced with a prescribed groove (concave).

Figure 1:
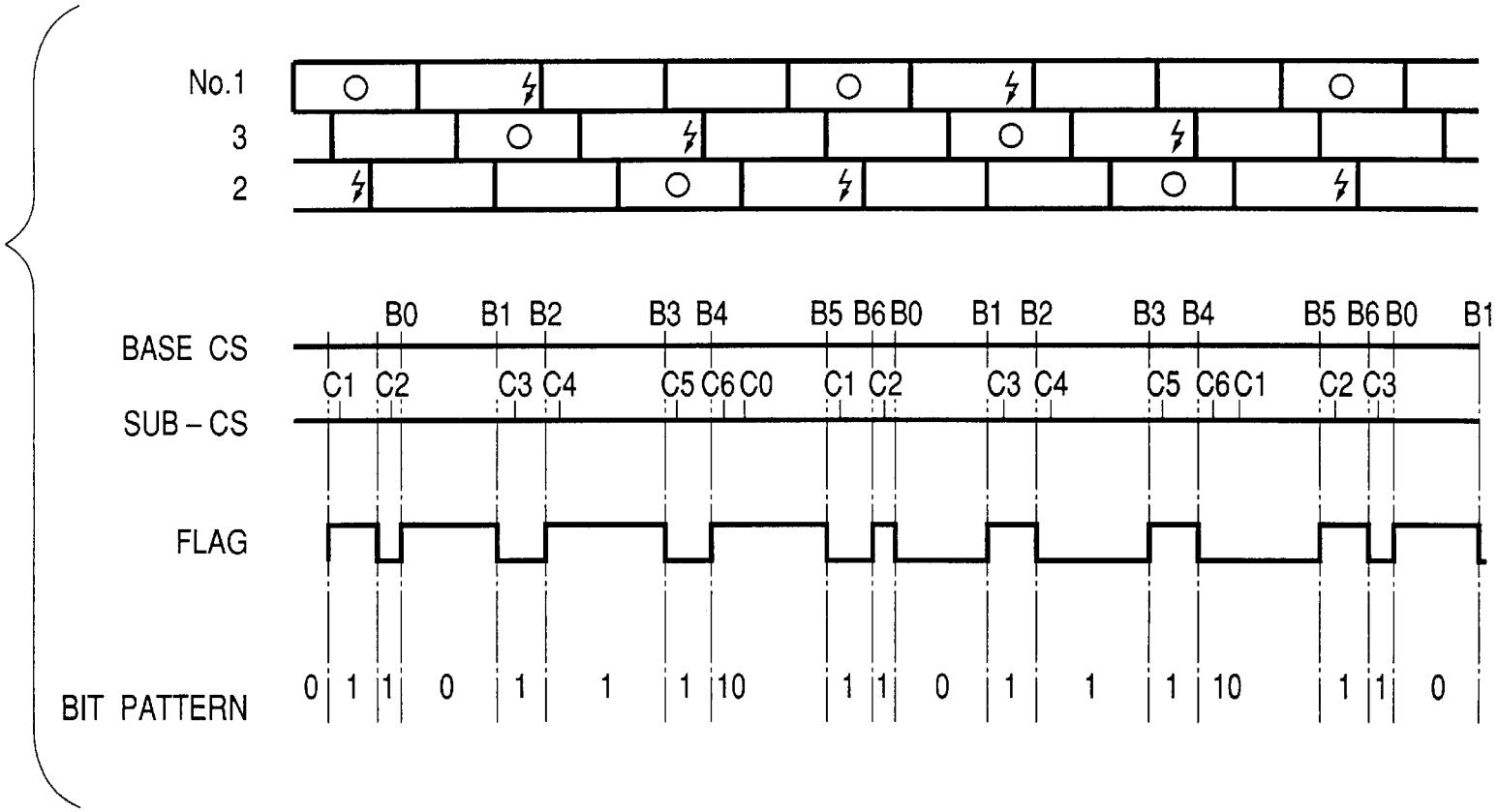
FIG. 1 is a diagram illustrating an example of method to implement cylinder identification according to the present invention.
Figure 2:
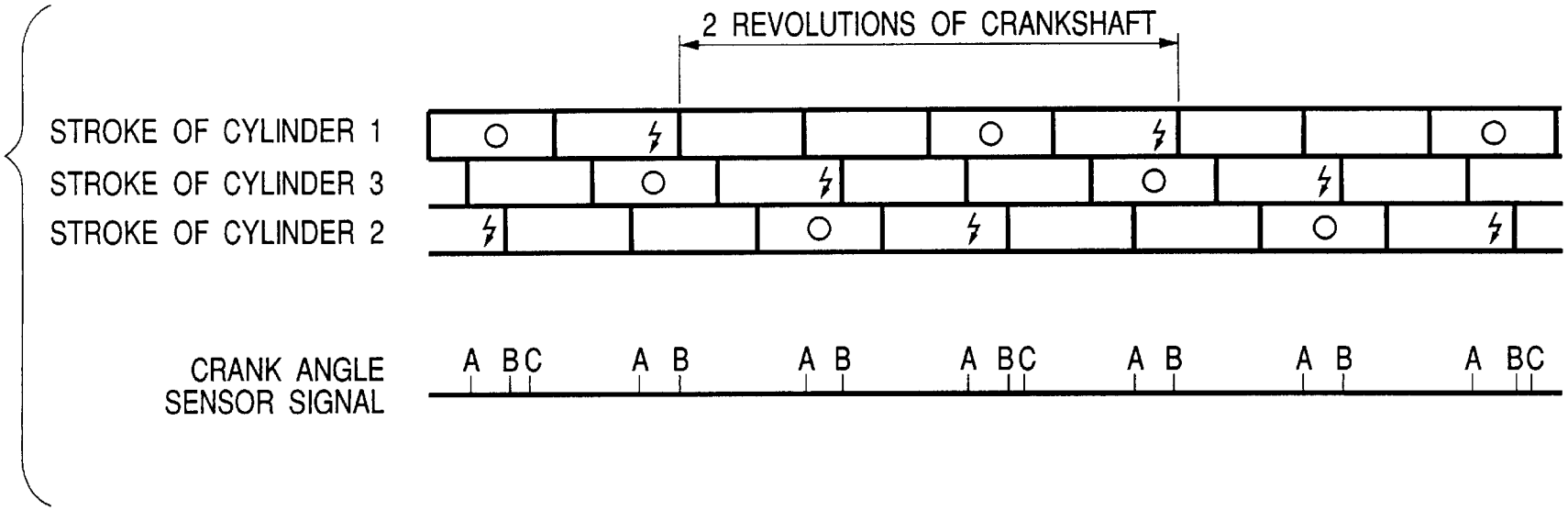
FIG. 2 is a diagram illustrating an example of method to implement cylinder identification according to the prior art.
Figure 3:
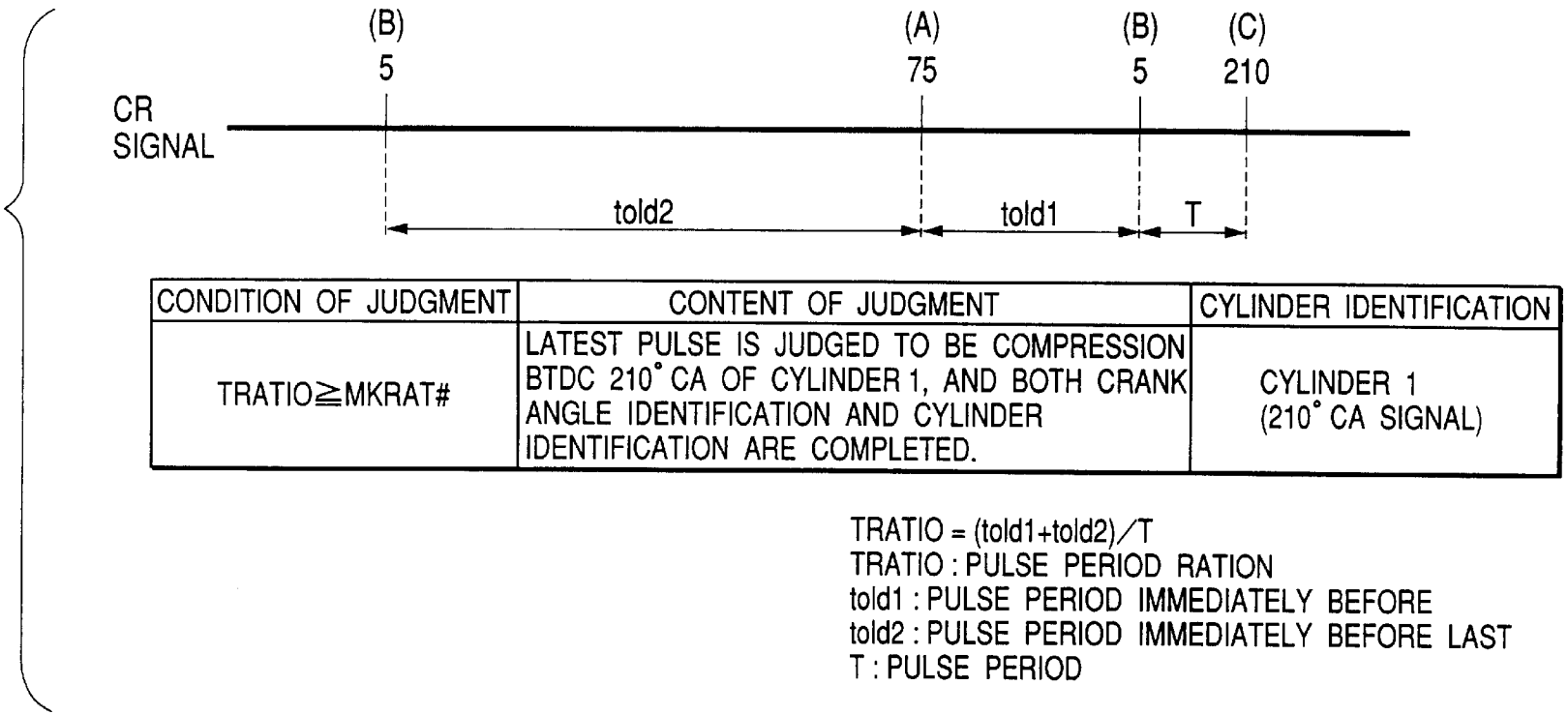
FIG. 3 is a diagram illustrating a method of cylinder identification according to the prior art.

FIG. 11 is a block diagram of the cylinder identifying method according to the invention. The BCAS signal is entered into an input processing means 210 and cleared of noise and the like. Next, a signal counting means 230 counts up a counter every time the signal is entered to monitor how many times the BCAS signal is entered. Similarly, a FLAG 0, 1 generating means 240, on the basis of a signal from the processing means 210, inverts the FLAG state between 0 and 1 every time the signal is entered from said input processing means 210. At the same time, the SCAS signal is also cleared of noise and the like by another input processing means 220, and delivered to a bit preparing means 250. The bit preparing means 250, on the basis of signals from the FLAG 0, 1 generating means and from the input processing means 220 for the SCAS signal, prepares a bit pattern. The bit pattern is prepared, using one byte (eight bits) of the RAM 195 shown in FIG. 6 as the register for bit pattern discrimination. The register for bit pattern discrimination is shifted leftward by a one-bit equivalent every time the signal from the FLAG 1, 0 generating means 240 is inverted (between 0 and 1). It also turns the least significant bit of the bit pattern register to 1 every time a signal is entered from the input processing means 220 for the SCAS signal. When the signal from the FLAG 0, 1 generating means 240 remains in the same state and a signal from the input processing means for the SCAS signal is entered twice, processing to turn the least significant bit to 0 after shifting the bit pattern register leftward is performed by a plural input processing means 260. Thus the sequence in the bit pattern is made "10". An example in which the above-described process is applied to a three-cylinder internal combustion engine is shown in FIG. 1. The state of the bit pattern register is generated in the sequence of 011011110 . . . as illustrated. Next, the bit pattern generated by the bit pattern preparing means 250 is delivered to a cylinder identifying means 280 to perform cylinder identification. Cylinder identification is accomplished as a cylinder identification criterion storage means 270 takes out predetermined data, and confirms its identity with said bit pattern. Its method is described below. First, the state of the count of the signal counting means 230 is monitored and, if the count is 3 (i.e. the BCAS signal has been entered three times), a bit pattern in a sequence of 110 is judged to mean the compression stroke of two cylinders. In other cases, a bit pattern in a sequence of 110 is judged to mean the compression stroke of one cylinder, and one in a sequence of 011 is judged to mean the compression stroke of three cylinders. Thus, when the entry of the BCAS signal has taken place three times, cylinder identification is made possible without fail.

Figure 12:
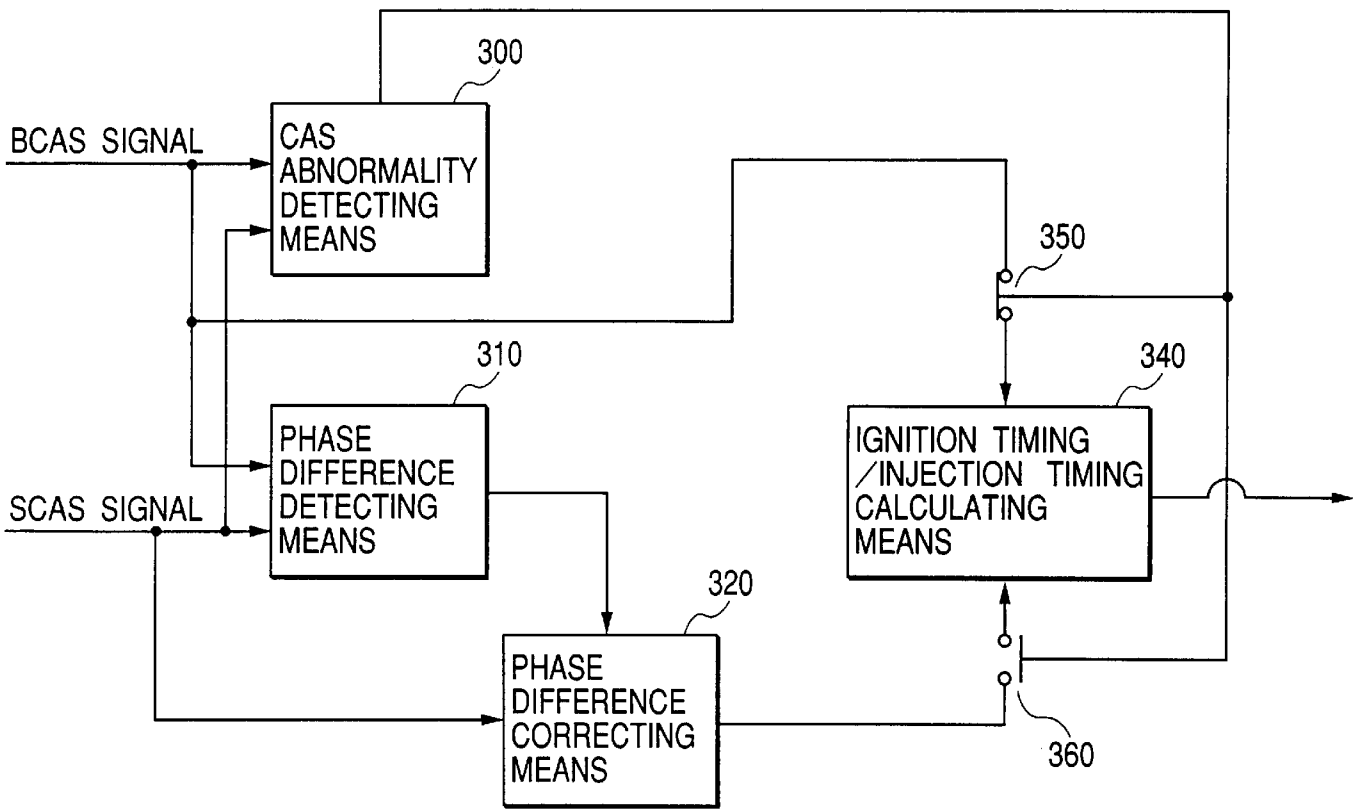
FIG. 12 is a block diagram illustrating the fail-safe method according to the invention.

Next will be described the fail-safe method to be applied in the event of a BCAS failure. FIG. 12 is a block diagram illustrating a fail-safe means. A BCAS signal is entered into a crank angle sensor (CAS) abnormality detecting means 300. The BCAS is judged to be abnormal when no BCAS signal is entered in spite of entry of a SCAS signal. In this case, the sensor judged to be abnormal is cut off, followed by switching to cylinder identification equivalent to the conventional practice by normal sensors alone. If the judgment indicates normalcy, a switch 350 is turned on and a switch 360 is turned off, with the BCAS signal delivered to an ignition timing/injection timing calculating means 340. If the judgment reveals abnormality, the switches 350 and 360 are turned on and off, respectively, and the ignition timing/injection timing calculating means 340 performs processing on the basis of a signal from a phase difference correcting means 320. Here it is relevant to describe the contents of the phase difference correcting means 320. First, a BCAS signal and an SCAS signal are entered by a phase difference correcting means 310. The period of time from the entry of the SCAS signal until that of the BCAS signal is measured to figure out the time ratio. This method is explained with reference to FIG. 1. Once cylinder identification is established, reference numbers B0 to B6 are assigned to the BCAS (base CS) signals in FIG. 1, and it is thereby made possible to determine the signal positions. B0 denotes the position of cylinder identification. Similarly, reference numbers C0 to C6 are assigned to the SCAS (sub-CS) signals. Therefore, since the signals having the same numerals, for instance B0 and C0, share the same projection position on the signal plate, their phases can be known if the time difference between them is figured out. As one cycle of an internal combustion engine is from one C0 to the next C0, the phase angle is calculated by Formula 3 below.

$$BSANGL=C0B00INT/C0INT\times 720 \qquad \text{Formula 3}$$

where

BSANGL is the CAS phase angle;

B0C0INT is the time between C0 and B0; and

C0INT is the time between C0 and C0.

Calculation of Formula 3 reveals the angle of the delay of the BCAS behind the SCAS. Next the phase difference correcting means 320, on the basis of said CAS phase angle, predicts the occurring positions of Bn(0~6) converted into a time basis. Since the method for angle-time conversion during the operation of an internal combustion engine is known to persons skilled in the art, its explanation is dispensed with here. As so far described, in the event of a BCAS failure, the phase correction means, using BSANGL calculated in advance, predicts the BCAS signal occurring position on the basis of the SCAS signal, and delivers a pertinent signal to the ignition timing/injection timing calculating means, thereby making possible continued operation of the internal combustion engine.

Along with the revolutions of the internal combustion engine, detection signals are delivered from the first sensor (BCAS) and the second sensor (SCAS). The register for bit pattern discrimination is shifted leftward by a one-bit equivalent every time a signal is entered from the first sensor (BCAS). Also, every time a signal is entered from the second sensor (SCAS), the least significant bit of the bit pattern register is turned to 1. If a signal from the second sensor (SCAS) is generated before a signal is generated from the first sensor (BCAS) (i.e. the former is generated twice), the least significant bit is turned to 0 after the bit pattern register is turned leftward. An example in which the above-described process is applied to a three-cylinder internal combustion engine is illustrated in FIG. 1. The state of the bit pattern register is generated in the sequence of 011011110 . . . as illustrated. Cylinder identification is classified according to the input state of the first sensor (BCAS). Thus, if a signal is entered from the first sensor (BCAS) three times, a bit pattern in a sequence of 110 is judged to mean the compression stroke of two cylinders. In other cases, the bit pattern is checked next time a signal is entered from the first sensor (i.e. for the fourth time). A bit pattern in a sequence of 110 is judged to mean the compression stroke of one cylinder, and one in a sequence of 011 is judged to mean the compression stroke of three cylinders. Thus, when the entry of a signal from the first sensor (BCAS) has taken place four times, cylinder identification is made possible without fail. Furthermore, in the event of failure of the first sensor (BCAS), cylinder identification is accomplished by the second sensor (SCAS) to control fuel feed and ignition.

Figure 13:
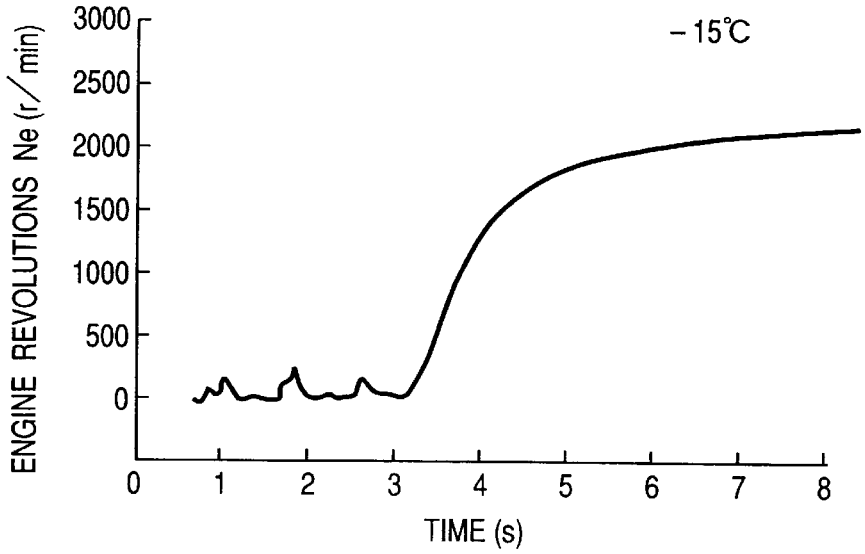
FIG. 13 is a diagram illustrating the result of confirmation at the of starting an internal combustion engine according to the prior art.
Figure 14:
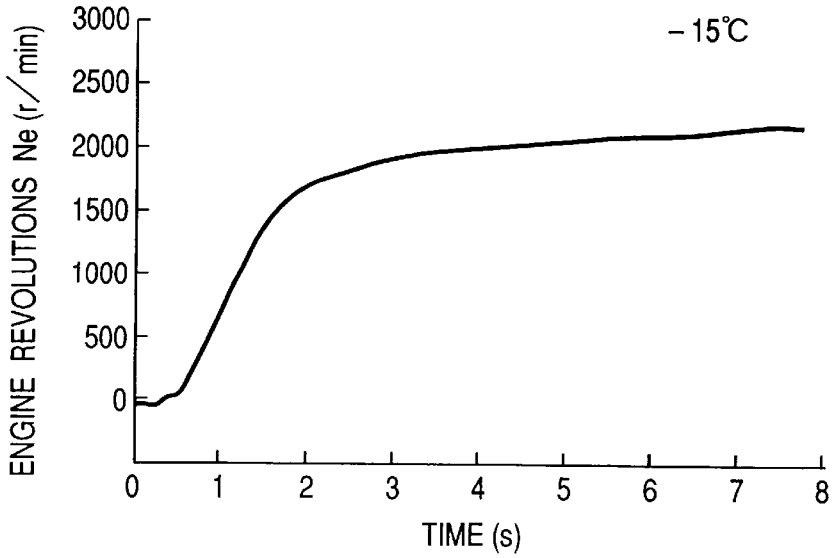
FIG. 14 is a diagram illustrating the result of confirmation at the of starting an internal combustion engine according to the invention.
Figure 15:
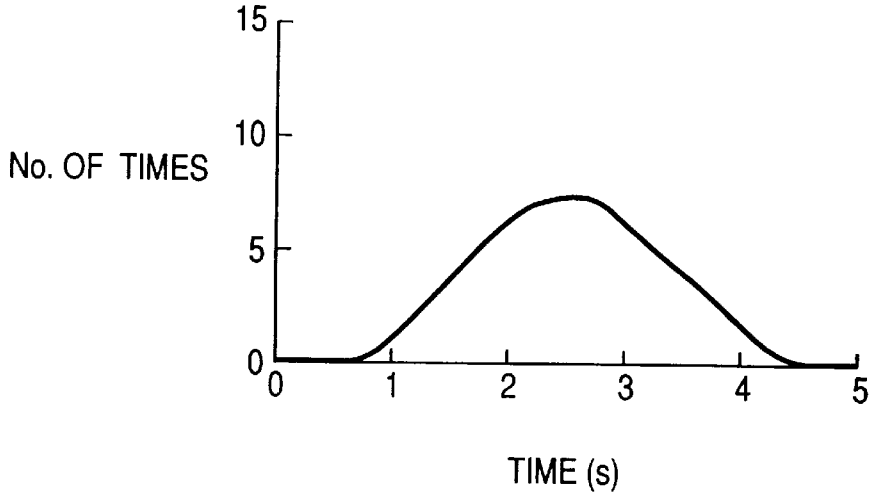
FIG. 15 is a diagram illustrating the distribution of starting times of an internal combustion engine according to the prior art.
Figure 16:
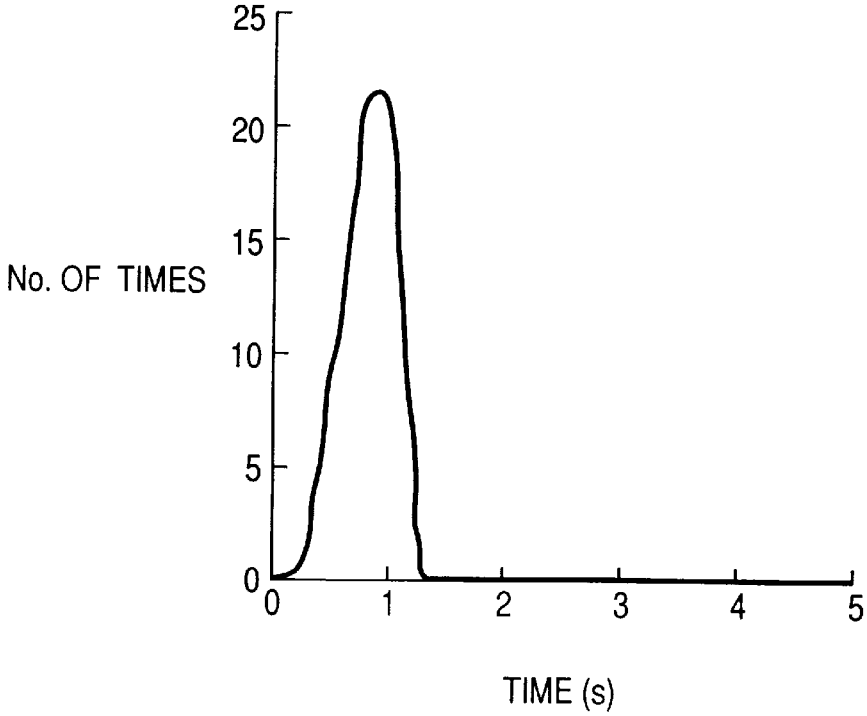
FIG. 16 is a diagram illustrating the distribution of starting times of an internal combustion engine according to the invention.

FIGS. 13 and 14 show the results of confirmation with real engines to which the prior art and the present invention were applied. Both illustrate the pattern of the frequency of revolutions during the start-up of an internal combustion engine. FIG. 13 illustrates the case in which the prior art was applied, wherein failure in cylinder identification was repeated on account of great fluctuations in revolution at the time of starting the engine, which took more than three seconds to start. On the other hand, FIG. 14 illustrates the case in which the invention was implemented, wherein cylinder identification was promptly accomplished as the ill effect of fluctuations in revolution was absent, and the engine was started in less than one second. These results are statistically expressed in FIGS. 15 and 16. FIG. 15 shows the distribution of starting times, and FIG. 16 illustrates a corresponding case where the invention was implemented. These diagrams reveal that the implementation of the invention makes it possible to reduce both fluctuations and the absolute length of the starting time. Thus, at the time of starting an internal combustion engine, cylinder identification can be accomplished before the camshaft completes a maximum of one full revolution, i.e. before the crankshaft completes two revolutions, and furthermore, because cylinder identification is accomplished without using the time ratio among cylinders, there is no fear of misidentification even with an internal combustion engine with substantial fluctuations in revolution. Even in the event of failure of the BCAS, the fuel feed to and ignition of the internal combustion engine can be controlled by the SCAS, and the internal combustion engine can be prevented from stopping.

What is claimed is:

1. A cylinder identification device for internal combustion engines comprising: a signal plate fitted to the camshaft; and two detecting sensors having as many groups of concave parts or convex parts as the cylinders of the internal combustion engine, having, as the reference groups of concave parts or convex parts, concave or convex parts in an unequal number in one of said groups of concave parts or convex parts from other groups of concave parts or convex parts, and so arranged as to detect signals based on said groups of concave parts or convex parts.

2. A cylinder identification device for internal combustion engines, as claimed in claim 1, said groups of concave parts or convex parts are disposed to be equal in number to the quotient of a crank angle of 720 degrees by the number of cylinders of said internal combustion engines.

3. A cylinder identification device for internal combustion engines, as claimed in claim 1, wherein said two detecting sensors are arranged at such a phase difference that, between signals detected by one of said two detecting sensors (a first sensor) according to individual concave parts or individual convex parts of said groups of concave parts or convex parts, at least one detection signal is contained as a signal from the other detecting sensor (a second sensor).

4. A cylinder identification device for internal combustion engines, as claimed in claim 3, further including a means to generate a 0, 1 or high, low signal every time a signal is entered from said first sensor, and a means to give a bit 1 if there is a signal from said second sensor between signals from said first sensor, or a bit 0 if there is not, and to give, if there are two signals from said second sensor between signals from said first sensor, a bit 1 to the first signal and a bit 0 to the second signal, wherein cylinder identification is accomplished according to patterns of the combination of these bits.

5. A cylinder identification device for internal combustion engines, as claimed in claim 3, further provided with a phase difference detecting means for detecting any phase difference between signals generated by said first sensor and said second sensor, and a phase corrective means for correcting, where the phase difference detected by said phase difference detecting means manifests a disparity from a predetermined reference phase difference, an equivalent of phase difference to said disparity.

6. A cylinder identification device for internal combustion engines, as claim in claim 3, further provided with a means for detecting, or judging the presence or absence of, any output signal from said first sensor and said second sensor; an abnormality detecting means for determining to be abnormal, in the event of the result of output signal detection or of the judgment of output signal presence or absence differs between said first sensor and said second sensor, either of the first or second sensor from which an output signal has been judged absent; and a switching means for making, in the event of abnormality of either of said sensors, the non-abnormality sensor independent from the other sensor, with which abnormality has been detected, and causing it to perform cylinder identification by itself.

* * * * *